US007163240B2

(12) United States Patent
Odahara

(10) Patent No.: US 7,163,240 B2
(45) Date of Patent: Jan. 16, 2007

(54) VEHICLE DOOR HANDLE DEVICE

(75) Inventor: Jun Odahara, Yamanashi-ken (JP)

(73) Assignee: Mitsui Mining & Smelting Co., Ltd., Tokyo (JP)

( * ) Notice: Subject to any disclaimer, the term of this patent is extended or adjusted under 35 U.S.C. 154(b) by 0 days.

(21) Appl. No.: 10/864,863

(22) Filed: Jun. 10, 2004

(65) Prior Publication Data

US 2005/0184535 A1 Aug. 25, 2005

(30) Foreign Application Priority Data

Jun. 10, 2003 (JP) ..... 2003-165243

(51) Int. Cl.
*E05B 1/00* (2006.01)

(52) U.S. Cl. ..... 292/347; 292/DIG. 22

(58) Field of Classification Search ..... 292/DIG. 22, 292/336.3, DIG. 65, 347
See application file for complete search history.

(56) References Cited

U.S. PATENT DOCUMENTS 3,400,446 A * 9/1968 Yulkowski ..... 29/463
5,263,750 A * 11/1993 Smith et al. ..... 292/336.3
6,010,167 A * 1/2000 Tanimoto et al. ..... 292/336.3
6,073,397 A * 6/2000 Tanimoto et al. ..... 49/460
2001/0035656 A1* 11/2001 Stuart et al. ..... 292/347

FOREIGN PATENT DOCUMENTS

JP 2000-45579 * 2/2000

* cited by examiner

*Primary Examiner*—Gary Estremsky
(74) *Attorney, Agent, or Firm*—Browdy and Neimark, PLLC

(57) ABSTRACT

A vehicle door handle device includes a base case secured to a door, and an L-shaped handle lever rotatably mounted on the base case by a supporting shaft and connected to a latch device of the door by way of a connecting member. The handle lever includes an operation arm extending in a first direction and receiving a manual operational force and a coupling arm extending in a second direction substantially orthogonal to the first direction to be connected to the connecting member. The operation arm is made of a synthetic resin and has a small specific gravity, and the coupling arm is made of a metal and has a great specific gravity. The base portions of the operation arm and the coupling arm are undetachably coupled with each other by the supporting shaft.

9 Claims, 2 Drawing Sheets

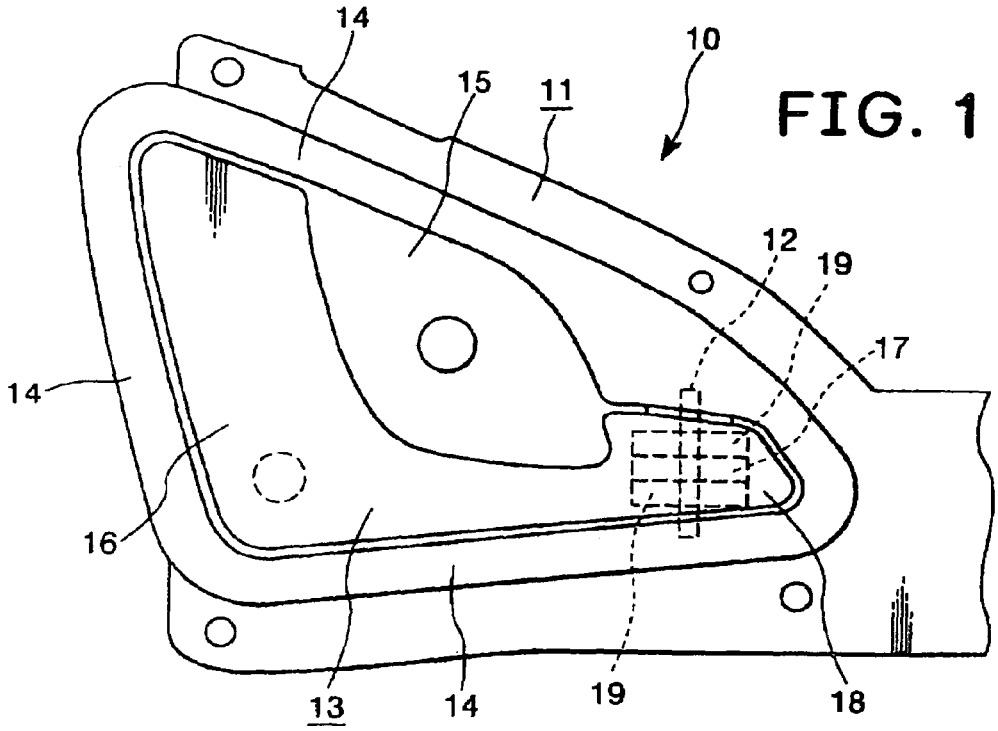
FIG. 1
FIG. 3
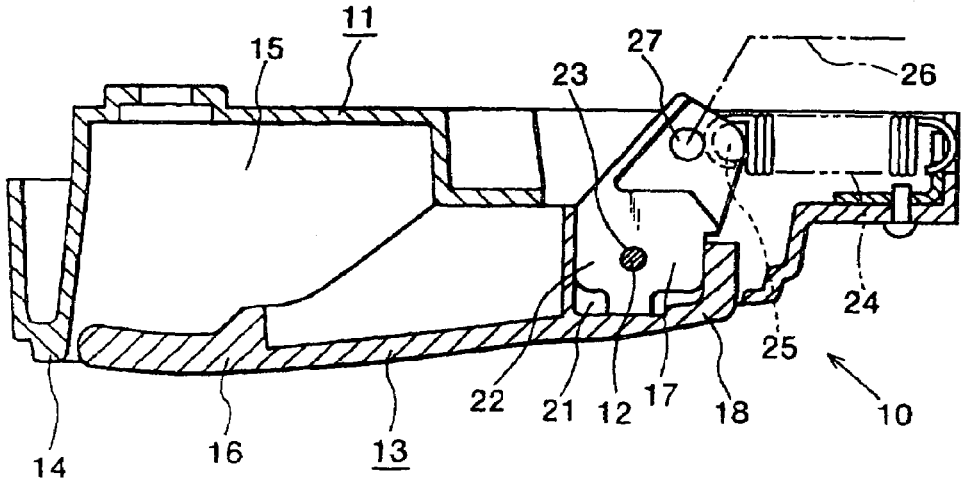

VEHICLE DOOR HANDLE DEVICE

BACKGROUND OF THE INVENTION

1. Field of the Invention

The present invention relates to a vehicle door handle device, and particularly, relates to a balance weight of a handle lever of the vehicle door handle device.

2. Description of the Related Art

A conventional vehicle door handle device has a base case secured to a door, and an L-shaped handle lever rotatably mounted on the base case with a supporting shaft and connected to a latch device of a vehicle door by way of a coupling member. The latch device is unlatched by rotation of the handle lever in a door-opening direction from an initial position around the supporting shaft.

The handle lever is kept in the initial position with an elastic force of a return spring. A great force applied to a vehicle body at an accident and the like, however, may turn the handle lever in the door-opening direction against the elastic force of the return spring. This is because an unpreferable inertia force may act on the handle lever due to an impact at the accident.

Providing a balance weight to the handle lever or the latch device (with which the handle lever is coupled) may decrease the above inertia force.

However, the conventionally proposed balance weight requires a large mounting space, and there have been problems in designing the door handle device.

BRIEF DESCRIPTION OF THE DRAWINGS

FIG. 1 is a front view of a door handle device of the present invention;

FIG. 3 is a transverse cross-sectional view of the door handle device;

DESCRIPTION OF THE PREFERRED EMBODIMENT

Figure 2:
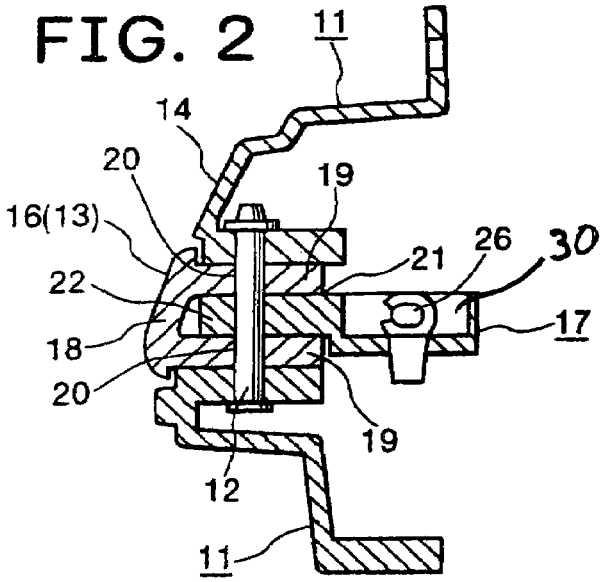
FIG. 2 is a longitudinal cross-sectional view of the door handle device.
Figure 5:
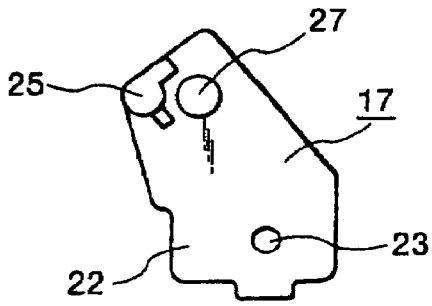
FIG. 5 is a back view of the coupling arm.
Figure 4:
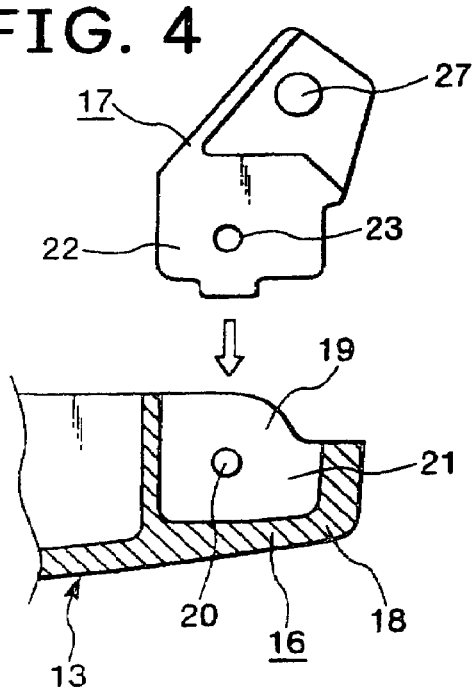
FIG. 4 is an exploded view of an operation arm and a coupling arm.
Figure 6:
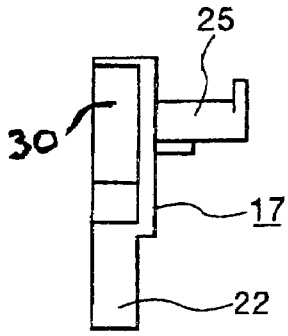
FIG. 6 is a side view of the coupling arm.

Hereinafter described referring to drawings are embodiments of the present invention. A door handle device 10 of a vehicle door (not shown) of the present invention is shown as an inside handle device which is operated from inside a room. The door handle device 10 has a base case 11 to be secured to the vehicle door with screws and the like, and a handle lever 13 rotatably mounted on the base case 11 by a vertical supporting shaft 12. On front surface of the base case 11 a substantially triangle shaped bulging flange 14 is formed, and a main portion of the handle lever 13 is accommodated in a concave portion 15 of the base case 11 which is surrounded by the bulging flange 14.

The handle lever 13 of the present invention includes an operation arm 16 and a coupling arm 17 which is formed separately from the operation arm 16. The operation arm 16 is made of a synthetic resin and has a small specific gravity, and the coupling arm 17 is made of a metal (preferably zinc die-casting) and has a large specific gravity. The operation arm 16 has a base portion 18 which is formed integrally with a pair of support members 19, 19 which are disposed upward and downward at a predetermined distance. The support members 19, 19 have support holes 20, 20 into which the supporting shaft 12 is inserted.

The base portion 18 of the operation arm 16 is formed with a socket 21 into which a base portion 22 of the coupling arm 17 is inserted. The socket 21 has a substantial rectangular shaped space with a backside opening. Upper and lower faces of the socket 21 are defined by the support members 19, 19, respectively.

The base portion 22 of the coupling arm 17 is formed with a through hole 23 coinciding with the support holes 20, 20. When the base portion 22 is fitted into the socket 21 and the supporting shaft 12 is inserted into the holes 20, 20, 23, the coupling arm 17 and the operation arm 16 can be joined with each other without a backlash. With this, the operation arm 16 extending in parallel with the door face and the coupling arm 17 extending substantially orthogonally to the operation arm 16 can form the substantially L-shaped handle lever 13.

The coupling arm 17 has a protrusion 25 at a tip end thereof with which a first end of a return spring 24 is engaged. The tip end of the coupling arm 17 is also formed with an engagement portion 27 which is engaged with a rod (or a wire) 26 extending to a latch device (not shown) of the vehicle door. A second end of the return spring 24 is engaged with the base case 11 so that the handle lever 13 can be biased in the clockwise direction in FIG. 3 by means of an elastic force of the return spring 24 toward an initial position of the handle lever.

Alternatively, forming the socket 21 in the coupling arm 17 and thereby inserting the base portion 18 of the operation arm 16 into the thus formed socket 21 is allowed.

In the present invention, forming the large-sized operation arm 16 using the low specific gravity synthetic resin and forming the small-sized coupling arm 17 using the high specific gravity metal can decrease weight difference between the operation arm 16 and the coupling arm 17. With this, the coupling arm 17 can function as a balance weight. Thereby, an unpreferable inertia force caused to the handle lever 13 can be decreased, even when a great external force is applied to the vehicle.

Moreover in the present invention, the coupling arm 17 preferably has its center of gravity provided on an opposite side of a center of gravity of the operation arm 16, taking the supporting shaft 12 as a boundary. With the above structure, the unpreferable inertia force caused to the handle lever 13 can be further decreased.

Moreover in the present invention, the handle lever 13 even having the function of the balance weight can have substantially the same size and configuration as those of the conventional handle lever, thus eliminating the need for a extra space for the balance weight and facilitating designing of the handle device 10.

Coupling the operation arm 16 with the coupling arm 17 can be carried out by simply inserting the base portion 22 of the coupling arm 17 into the socket 21 of the operation arm 16 and thereafter inserting the supporting shaft 12 into the support holes 20, 20 and the through hole 23, facilitating assembly work and decreasing parts.

What is claimed is:

1. A vehicle door handle device having a base case secured to a door, and an L-shaped handle lever rotatably mounted on the base case by a supporting shaft and connected to a latch device of the door by way of a connecting member, said L-shaped handle lever comprising:

an operation arm extending in a first direction and receiving a manual operational force, said operation arm being made of a synthetic resin and having a small specific gravity, and a coupling arm extending in a second direction substantially orthogonal to the first direction and connected to the connecting member, said coupling arm being made of a metal and having a great specific gravity, wherein a base portion of the operation arm has a socket into which a base portion of the coupling arm is inserted, wherein the base portion of the operation arm and the base portion of the coupling arm are undetachably coupled with each other by the supporting shaft, and device wherein the socket has a rectangular shaped space.

2. The vehicle door handle device according to claim 1, wherein a base portion of the operation arm and a base portion of the coupling arm are undetachably coupled with each other by the supporting shaft.

3. The vehicle door handle device according claim 2, wherein the coupling arm has a center of gravity thereof opposite to a center of gravity of the operation arm, with respect to the supporting shaft.

4. The vehicle door handle device according to claim 1, wherein the coupling arm is formed integrally with a protrusion with which a first end of a return spring is engaged so that the handle lever is urged toward an initial position of the handle lever.

5. A vehicle door handle device having a base case secured to a door, and an L-shaped handle lever rotatably mounted on the base case by a supporting shaft and connected to a latch device of the door by way of a connecting member, said L-shaped handle lever comprising:

an operation arm extending in a first direction and receiving a manual operational force, said operation arm being made of a synthetic resin and having a small specific gravity, and a coupling arm extending in a second direction substantially orthogonal to the first direction and connected to the connecting member, said coupling arm being made of a metal and having a great specific gravity, wherein a base portion of the coupling arm has a socket into which a base portion of the operation arm is inserted.

6. The handle device according to claim 5, wherein the base portion of the operation arm and the base portion of the coupling arm are undetachably coupled with each other by the supporting shaft.

7. The vehicle door handle device according to claim 6, wherein the socket has a rectangular shaped space.

8. The vehicle door handle device according to claim 5, wherein the coupling arm is formed integrally with a protrusion with which a first end of a return spring is engaged so that the handle lever is urged toward an initial position of the handle lever.

9. The vehicle door handle device according to claim 6, wherein the coupling arm is formed integrally with a protrusion with which a first end of a return spring is engaged so that the handle lever is urged toward an initial position of the handle lever.

* * * * *